US006428221B1

(12) United States Patent
Dolce et al.

(10) Patent No.: US 6,428,221 B1
(45) **Date of Patent: *Aug. 6, 2002**

(54) PACKAGE WITH WEB ROLL AND TAKE-UP CORE

(75) Inventors: Anthony C. Dolce, Lockport; Robert S. Eaton, Buffalo; Joel D. Neri, Youngstown, all of NY (US)

(73) Assignee: International Imaging Materials, Inc., Amherst, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/677,391

(22) Filed: Oct. 2, 2000

Related U.S. Application Data

(63) Continuation-in-part of application No. 09/354,228, filed on Jul. 16, 1999, now Pat. No. 6,224,277.

(51) Int. Cl.[7] ..... B65H 18/28; B65H 75/28; B65D 85/672

(52) U.S. Cl. ..... 400/238; 400/207; 242/160.1; 242/160.4; 206/393

(58) Field of Search ..... 400/238, 207, 400/208, 208.1, 237; 242/160.1, 160.4; 206/393

(56) References Cited

U.S. PATENT DOCUMENTS

| | | | | |
|---|---|---|---|---|
| 1,441,146 A | * | 1/1923 | Eastman | 430/501 |
| 1,850,718 A | | 3/1932 | Henderson | |
| 2,732,063 A | | 1/1956 | Dedek et al. | |
| 2,912,102 A | | 11/1959 | Scott | |
| 3,022,170 A | * | 2/1962 | Flinchbaugh et al. | 430/501 |
| 3,108,675 A | | 10/1963 | Rooney | |
| 3,286,808 A | | 11/1966 | Arena et al. | |
| 3,460,671 A | | 8/1969 | Harm | |
| 3,476,238 A | | 11/1969 | Wright et al. | |
| 4,475,830 A | | 10/1984 | Schaefer | |
| 4,622,698 A | * | 11/1986 | Heyman et al. | 2/48 |
| 4,809,018 A | | 2/1989 | Nakamura et al. | |
| 5,254,445 A | * | 10/1993 | Takamuki et al. | 430/501 |
| 5,269,612 A | | 12/1993 | Shimoha et al. | |
| 5,415,486 A | | 5/1995 | Wouters et al. | |
| 5,492,221 A | | 2/1996 | Light et al. | |
| 5,536,094 A | | 7/1996 | Kondo | |
| 5,547,298 A | | 8/1996 | Wouter et al. | |
| 5,839,839 A | | 11/1998 | Brot et al. | |
| 6,190,821 B1 | * | 2/2001 | Vandenabeele | 430/139 |
| 6,224,277 B1 | * | 5/2001 | Dolce et al. | 400/238 |

FOREIGN PATENT DOCUMENTS

| | | |
|---|---|---|
| JP | 59-54589 | 3/1984 |
| JP | 61-244582 | 10/1986 |
| JP | 6-115229 | 4/1994 |
| JP | 7-314868 | 12/1995 |

* cited by examiner

*Primary Examiner*—Daniel J. Colilla
(74) *Attorney, Agent, or Firm*—Joseph J. Grass

(57) ABSTRACT

Disclosed are various embodiments of packaging for a roll of a web which is attached to a take-up core. The web is arranged so that it packages the roll together with the core, ready for shipment without the need for additional packaging. The web can include an ink ribbon and a leader connected to the ink ribbon.

9 Claims, 14 Drawing Sheets

PACKAGE WITH WEB ROLL AND TAKE-UP CORE

CROSS-REFERENCE TO RELATED APPLICATION

This application is a continuation-in-part of patent application Ser. No. 09/354,228 filed Jul. 16, 1999 now U.S. Pat. No. 6,224,277.

BACKGROUND OF THE INVENTION

1. Field of the Invention

This invention relates to the art of packages and packaging and to methods of making and using packages.

2. Brief Description of the Prior Art

The following U.S. patents are made of record: U.S. Pat. Nos. 1,850,718; 2,732,063; 2,912,102; 3,460,671; 3,476,238; 5,415,486; 5,492,221; 5,536,094; 5,547,298; and 5,839,839.

It is known to provide an ink ribbon package including a web having an ink ribbon portion wound onto and adhesively adhered to a supply core and having an outwardly extending leader portion. The web is wound into a roll and the take-up core is adhesively attached to the end of the leader portion. One or more strips of pressure sensitive tape, separate from the web, extend generally longitudinally or lengthwise of the web beyond the leader portion and are adhered to the outside of the take-up core and/or the leader portion and to the outer surface of the roll to hold the roll and the take-up core together. The free end portions of the pressure sensitive adhesive tapes can be folded onto themselves to provide manually graspable tabs. The pressure sensitive tapes can be grasped by their tabs and peeled from the outer surface of the roll to unwrap the take-up core with respect to the roll. During the manufacturing process, the leader portion is connected to the ink ribbon portion using a commercially available leader-trailer bed and thereafter the ink ribbon portion and the leader portion are rewound in a commercially available rewinder.

SUMMARY OF THE INVENTION

It is a feature of the invention to provide improved packages and improved methods of making same, wherein the packages can be manufactured on conventional manufacturing equipment.

It is another feature of the invention to provide improved packages and improved methods of making same, wherein the web itself serves not only as the product to be used by the user, but the web also serves as the packaging material, without the need for additional packaging materials such as a shrink-wrap plastic outer wrapper, a carton or the like.

It is another feature of the invention to provide improved packages wherein a web roll is attached to a take-up core and wherein the web itself extends beyond the outside of the roll and serves as the packaging or wrapping.

It is another feature of the invention to provide an improved ink ribbon roll package which is economical to manufacture and is easy for the user to unwrap and use.

It is still another feature of the invention to provide an improved package for a web roll with an outer outwardly extending portion, wherein a take-up core is permanently transversely attached to the outer portion of the web and the web is removably attached to itself at a transversely extending stripe of adhesive.

It is a feature of the invention to provide an improved ink ribbon roll package, wherein the take-up core is secured to an outer portion of a web and wherein the outer portion of the web is wrapped around the roll and the core and is attached to itself.

It is another feature of the invention to provide an improved ink ribbon roll package, wherein the outer portion is secured to itself and outer portion is provided with adhesive with a release liner and wherein the release liner is subsequently removable for adherence of the adhesive to a take-up core.

Other features will be apparent to those skilled in the art upon reference to the following description and the accompanying drawings.

BRIEF DESCRIPTION OF THE DIAGRAMMATIC DRAWINGS

DETAILED DESCRIPTION OF THE PREFERRED EMBODIMENTS

Figure 1:
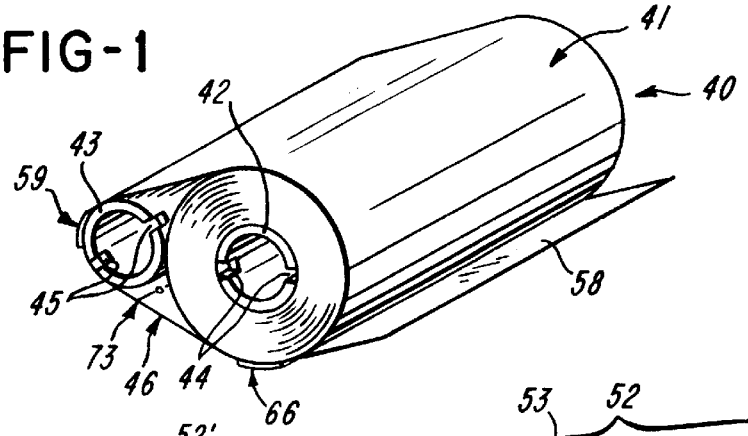
FIG. 1 is a perspective view of a package of the embodiment of FIGS. 1 through 8 including a web in roll form and a take-up core, wherein the web is also used as the wrapper or packaging.

With reference to the embodiment of FIGS. 1 through 8, and initially to FIG. 1, there is shown a package generally indicated at 40 including a roll 41 having a supply core 42 and a take-up core 43. The core 42 is shown to have notches 44, and the core 43 is shown to have notches 45. The notches 44 and 45 are typically used in a printer for advancing a web generally indicated at 46. Although notches 44 and 45 are illustrated, a greater or lesser number of notches, or no notches at all can be provided depending on the machine with which the cores are to be used.

Figure 2:
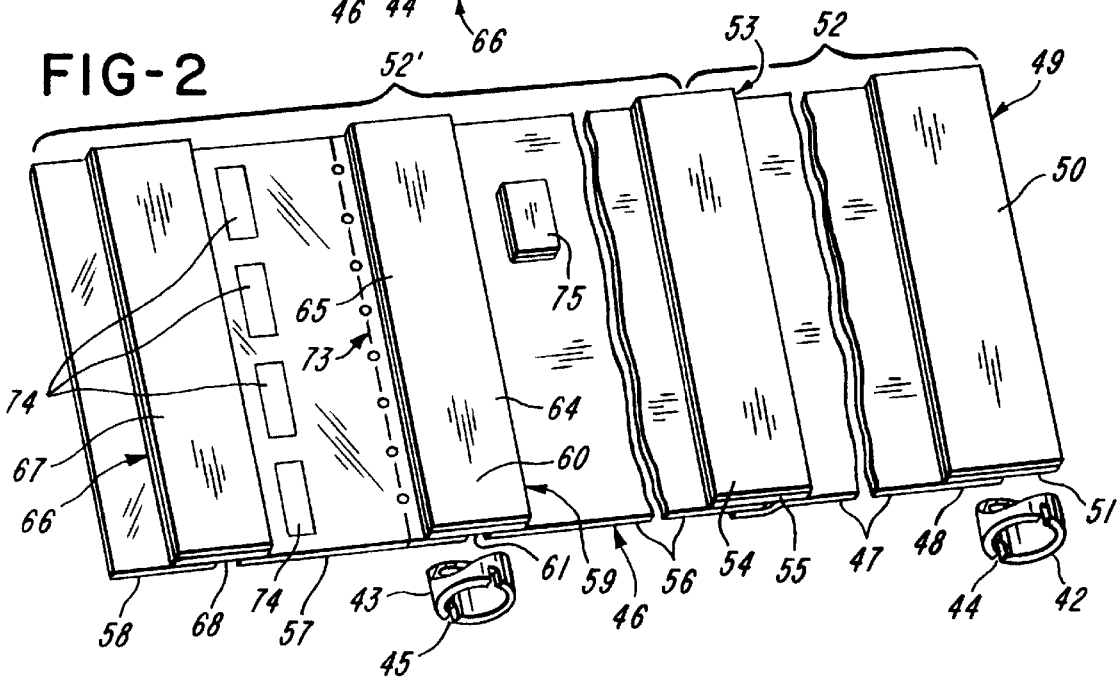
FIG. 2 is a developed, exploded, perspective view showing fragmentary portions of the web and the supply and take-up cores.
Figure 3:
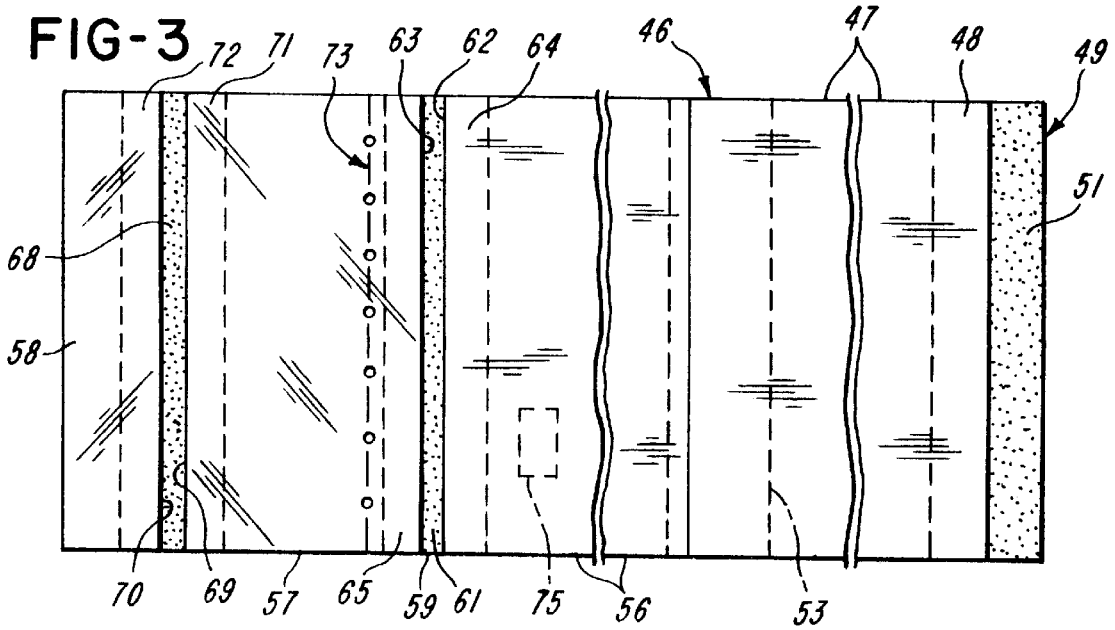
FIG. 3 is a bottom plan view of the web shown in detail in FIG. 2.
Figure 4:
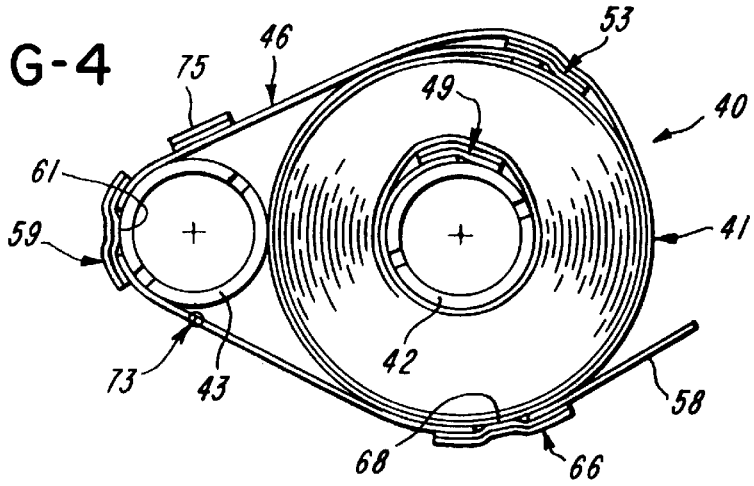
FIG. 4 is a side elevational view of the package.
Figure 5:
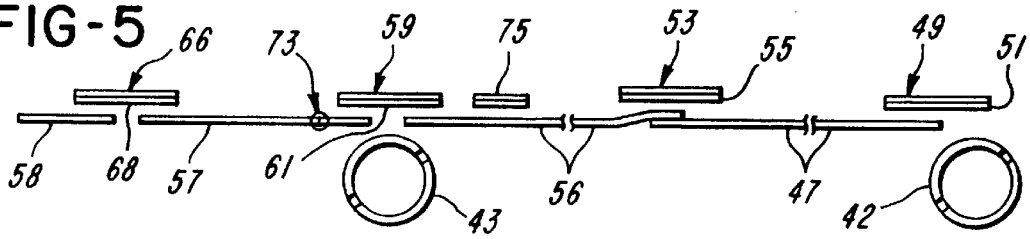
FIG. 5 is a developed, exploded, fragmentary, side elevational view of the web and the supply and take-up cores.

FIG. 2 shows the web 46 as including a main web portion 47 which occupies most of the length of the web 46. In this and in the other embodiments, the main web portion 47 has a coating and in particular a coating of ink and thus comprises an ink ribbon which includes a thin coating or layer of ink on a web of plastics film. The web 47 has a marginal end 48 to which a strip of pressure sensitive adhesive tape 49 is adhesively secured. The tape 49 is comprised of a flexible plastics film 50 with a uniform coating of adhesive 51. The adhesive 51 adheres the tape 49 to the marginal end 48 and adheres the web 46 to the core 42. The tape 49 overlaps the marginal end 48 and presents an exposed transversely extending adhesive stripe to the outer surface of the supply core 42. The web 46 includes a main web portion 52 which comprises almost all of the web 46, and the web 46 also includes a leader portion 52'. A transversely extending strip of adhesive tape 53 is comprised of a flexible plastics film 54 having a uniform coating of pressure sensitive adhesive 55. The tape 53 is shown connecting the overlapped ink ribbon portion 47 and leader portion 52'. The leader portion 52' is shown to be comprised of flexible leader strips 56, 57 and 58. The leader strips 56 and 57 are shown connected to each other by a transversely extending strip of adhesive tape generally indicated at 59 comprised of flexible plastics film 60 with a uniform coating of pressure sensitive adhesive 61. Terminal first ends 62 and 63 (FIG. 3) of the respective leader strips 56 and 57 are spaced apart and the tape 59 spans the space therebetween and is adhered to respective marginal first ends 64 and 65 of the leader strips 56 and 57. A stripe of the exposed adhesive 61 shown by stippling in FIG. 3 is face-to-face with the take-up core 43 as best shown in FIG. 4. The core 43 is secured to the stripe of adhesive 61 on the tape 59. The adhesive 61 preferably permanently attaches or adheres the take-up core 43 to the leader portion 52'.

A transversely extending strip of adhesive tape generally indicated at 66 connects the leader strips 57 and 58 to each other. The tape 66 has a flexible plastics film 67 and a uniform coating of pressure sensitive adhesive 68. Terminal ends 69 and 70 (FIG. 3) of the respective leader strips 57 and 58 are spaced apart. The tape 66 spans across the space between the terminal ends 69 and 70 and is adhered to marginal ends 71 and 72 of respective leader strips 57 and 58. The leader strip 58 provides a manually graspable tab.

While the leader portion 52' is illustrated as being a composite of leader strips 56, 57 and 58 and tapes 59 and 66, the leader portion 52'can be comprised of a single film or leader portion with transverse stripes of adhesive at the locations where the exposed adhesive 61 and 68 exists.

The leader strip 57 is shown to have weakening 73 along a line transversely across the web 46. The weakening 73 is preferably a line of perforations illustrated in FIGS. 2, 3 and 6 of the drawings by broken lines and intervening circles and in FIGS. 4, 5, 7 and 8 by small circles. The flexible adhesive strips 49, 53, 59 and 66 are shown to have considerable thickness for the sake of clarity, but one skilled in the art will recognize that these adhesive strips are thin, by way of example not limitation, on the order of between about 15 to 100 Microns and preferably about 6 Microns thick and the coated web portion or ink ribbon 47 is between about 3 to 15 Microns and preferably about 8 Microns thick.

FIG. 2 shows indicia 74 stating instructions for use, for example the words "Pull Here". A label 75 also bears indicia providing desired information.

In the embodiment of FIGS. 1 through 8, the web 46 is preferably essentially entirely an ink ribbon except for the leader portion 52'. The web 46 is wound into the configuration best shown in FIGS. 1 and 4. The exposed adhesive 68 is shown to hold the web 46 to itself. The adhesive 68 releasably adheres the web 46 to itself. For this purpose the adhesive 68, like the adhesive 61, may be of the permanent type. In that the adhesive 61 adheres to a take-up core 43 which is of paperboard material, the adherence is permanent. In the event the take-up core 43 were to be made of plastics material the aggressiveness of the adhesive should preferably be such as to adhere the web 46 permanently to the core 43. The adhesive 68 may also be of the permanent type, but because the adhesive 68 is adhered to the leader portion 52' comprised of plastics film such as polyethylene film the adhesive 68 is actually removably adhered to the film. If necessary, the adhesive 68 can be less aggressive than the adhesive 61.

The web 46 extends beyond the roll 41 to provide an outwardly extending portion. The web 46 encircles both the roll 41 and the core 43 to provide the packaging or wrapping for the package 40. In order to open or unwrap the package 40, the user manually grasps the tab 58 and pulls in a direction away from the roll 41, thereby releasing the web 46 from itself. Then the user tears the leader strip 57 along the line of weakening 73. The part of the leader portion 52' outwardly of the line of weakening 73 can now be discarded. Now the roll 41 and the take-up core 43 can be inserted into the utilization device, e.g. a printer, in which the web 46 is progressively unwound from the roll 41 and wound onto the take-up core 43. In the illustrated embodiment of FIGS. 1 through 8, the main portion of the web 46 of the roll 41 is an ink ribbon suitable for use in a printer for example a thermal printer. Indeed, almost the entire web 46 is comprised of ink ribbon.

Figure 6:
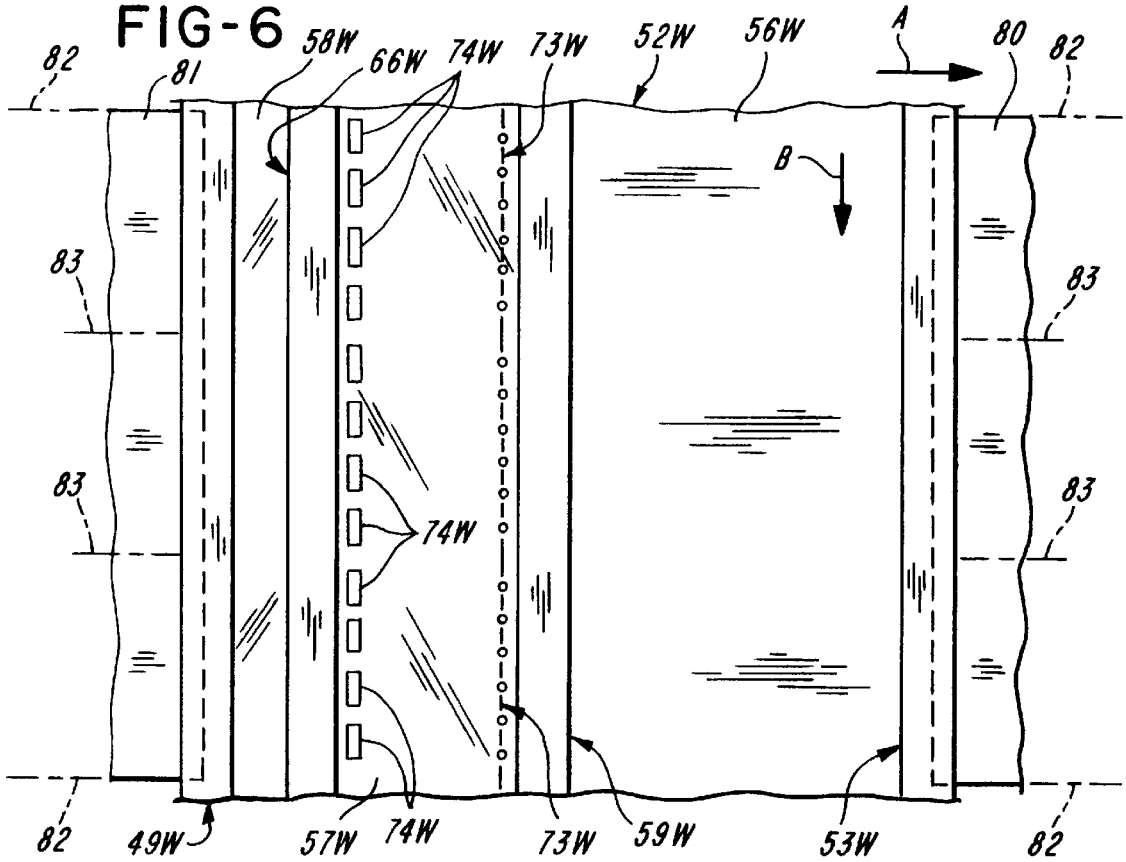
FIG. 6 is a top plan view showing a composite leader connecting two wide webs.

In the manufacture of a package 40, the ink ribbon is advanced from the ink ribbon production equipment to a leader-trailer bed (not shown) in the direction of arrow A in FIG. 6. While in the leader-trailer bed, the ink ribbon is slit transversely into wide webs 80 and 81 and the wide web 80 is advanced in the direction of the arrow A while the wide web 81 remains stationary. Next, a composite leader web 52W corresponding to the leader portion 52' is advanced in the direction of arrow B, but at a level above the plane of the webs 80 and 81. The composite leader web 52W is wider than the distance between the wide webs 80 and 81. The composite leader web 52W has leader strips 56W, 57W and 58W corresponding to leader strips 56, 57 and 58 and has pressure sensitive adhesive tape or strips 53W, 59W and 66W corresponding to the tape or strips 53, 59 and 66. The adhesive tape strip 49W is attached to the tab strip 58W and to the wide ink ribbon web 81. Next the leader web 52W is trimmed by slitting along lines 82 and 83 which run along the side edges of the webs 80 and 81. Thus, the webs 80 and 81 are connected by a leader web 52W for advancement to a rewinder diagrammatically illustrated in FIGS. 7 and 8. As the webs 80 and 81 and the intervening leader web 52W are advanced, slitting knives (not shown) slit the webs 80 and 81 and the web 52W along lines 83 into, for example, three narrow webs such as the web 46.

Figure 7:
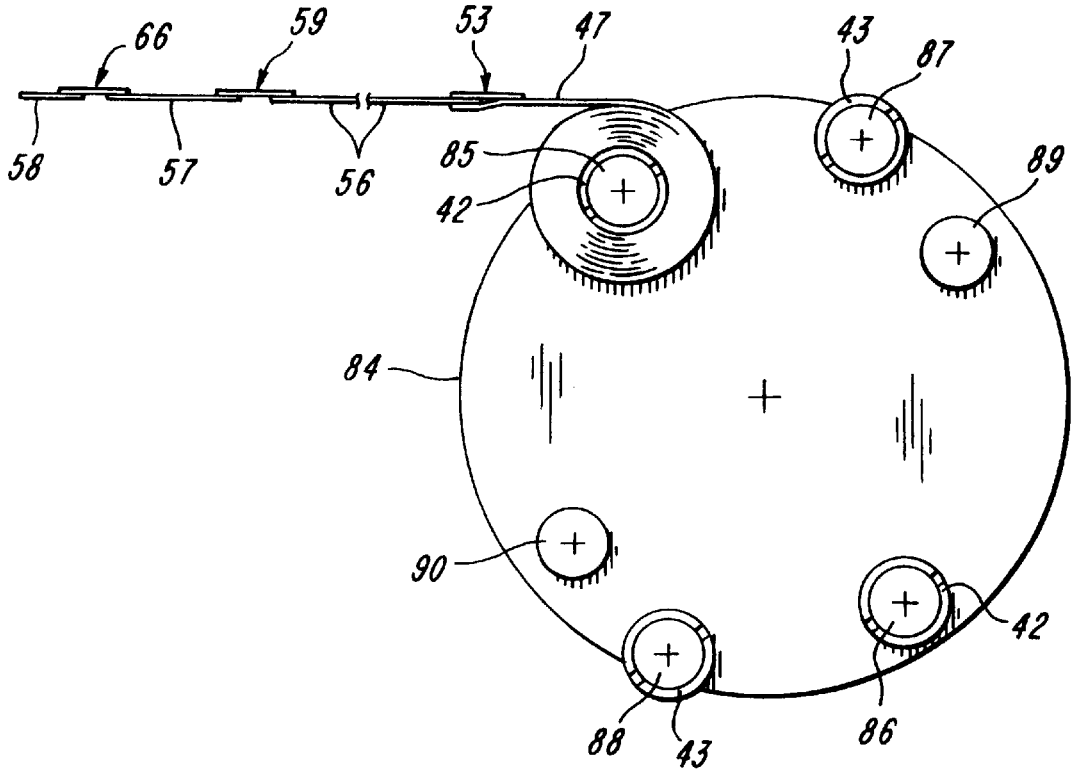
FIG. 7 is a diagrammatic view of a turret rewinder useful for practicing the invention, showing an ink ribbon as having been wound on a supply core.
Figure 8:
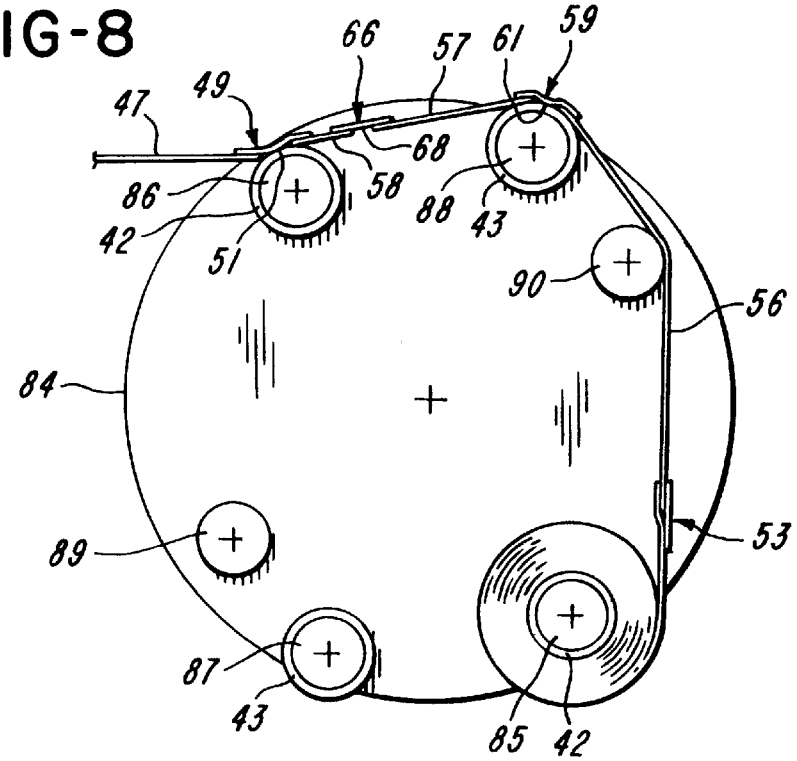
FIG. 8 is a view similar to FIG. 7, but showing the rewinder as having been indexed to a position where the take-up core is attached to the web and the next web is ready to be wound onto the next supply core.

With reference to FIGS. 7 and 8, the rewinder 84 can rewind the three narrow webs. The rewinder 84 has two opposed turrets 85 and 86 on which supply cores 42 can be mounted. Each turret 85 and 86 also has opposed pairs of holders 87 and 88 on which take-up cores 43 can be mounted. The rewinder 84 also has opposed edge guides 89 and 90.

With reference to FIG. 7, the rewinder 84 is shown in a position in which the ink ribbon 47 is almost entirely wound onto the core 42 on the turret 86. The turret 84 is now indexed clockwise into the FIG. 8 position at which the exposed stripe of adhesive 61 on the tape 59 is against and in contact with the outer periphery of the take-up core 43. The machine operator now lightly presses the tape 59 against the take-up core 43 to better adhere the adhesive 61 to the take-up core 43. Next the operator presses the tape 49 against the core 42 so that the adhesive 51 adheres permanently against the core 42. The operator then peels the tape 49 from the leader strip 58 and presses the remainder of the tape 49 against the core 42. The operator now removes the take-up core 43 from the turret and between edge guides 90, takes up any slack by winding the leader portion 52' around the ink ribbon roll 41 (shown at the bottom of FIG. 8), and adheres the exposed stripe of adhesive 68 of the tape 66 to the outer surface of the web 46. Although the adhesive 68 is adhered to the outer surface of the roll 41 it can be attached anyplace on the outer wrap. The now-completed package 41 is slipped off the turret 85, and the same process can proceed for the next ink ribbon.

Figure 9:
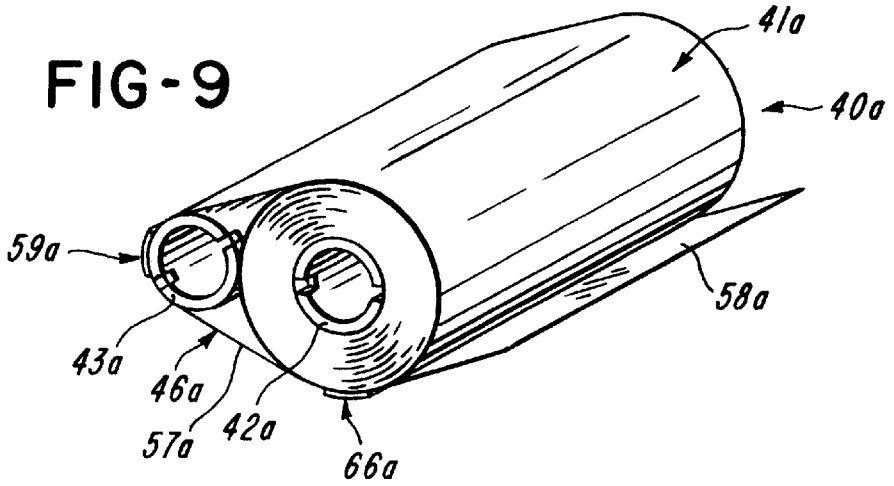
FIG. 9 is a perspective view of a package of the embodiment of FIGS. 9 through 11.
Figure 10:
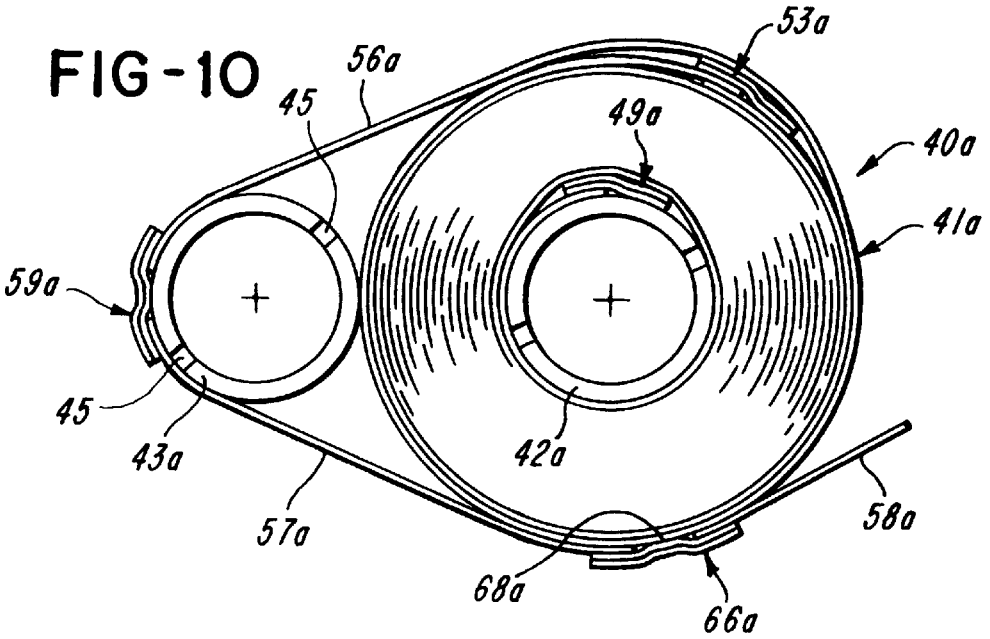
FIG. 10 is a side elevational view of the package.
Figure 11:
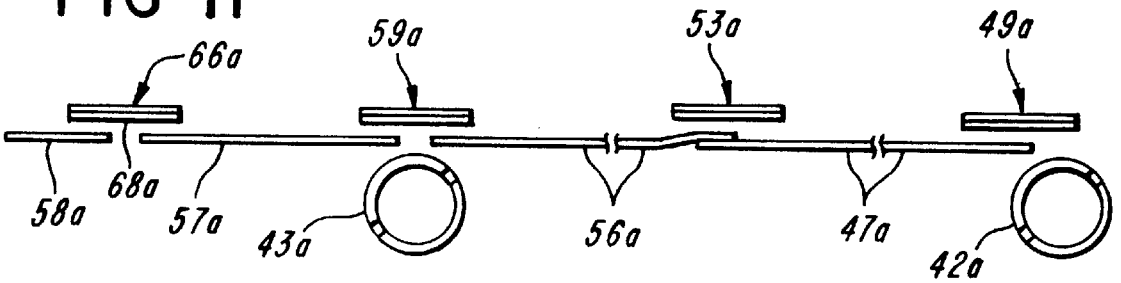
FIG. 11 is a developed, exploded, fragmentary, side elevational view of the web and the supply and take-up cores.

In the embodiment of FIGS. 9 through 11, the same reference characters are used as in the embodiment of FIGS. 1 through 8 for components having the same structure, function and relative location, with the addition of the letter "a". The package 40*a* differs from the package 40 only in that there is no line of weakening such as the line of weakening 73 of the package 46. The manner of use of the package 40*a* differs from that of the package 40 in that after the user pulls on the tab 58*a* to unstick the adhesive 68*a* of the tape 66*a* from the outer surface of the roll 41*a*, the leader strip 57*a* and the tab strip 58*a* can simply be wrapped up about the take-up core 42 as after the take-up core 42 and the supply core 44*a* are installed in the printer.

Figure 12:
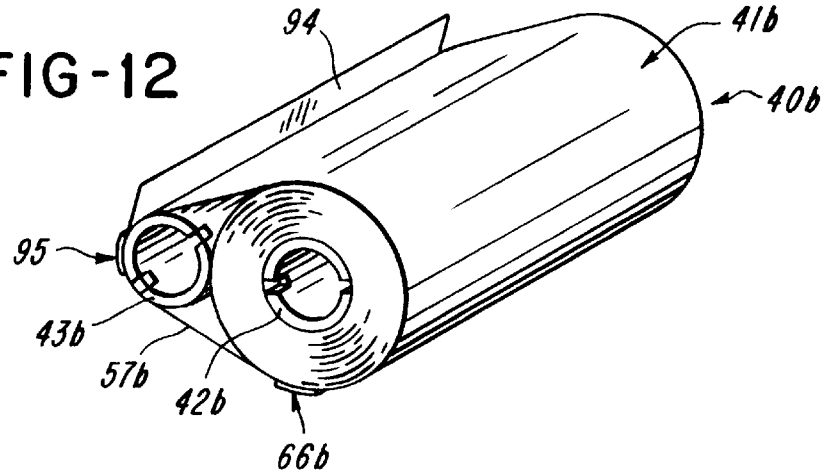
FIG. 12 is a perspective view of a package in accordance with the embodiment of FIGS. 12 through 14.
Figure 13:
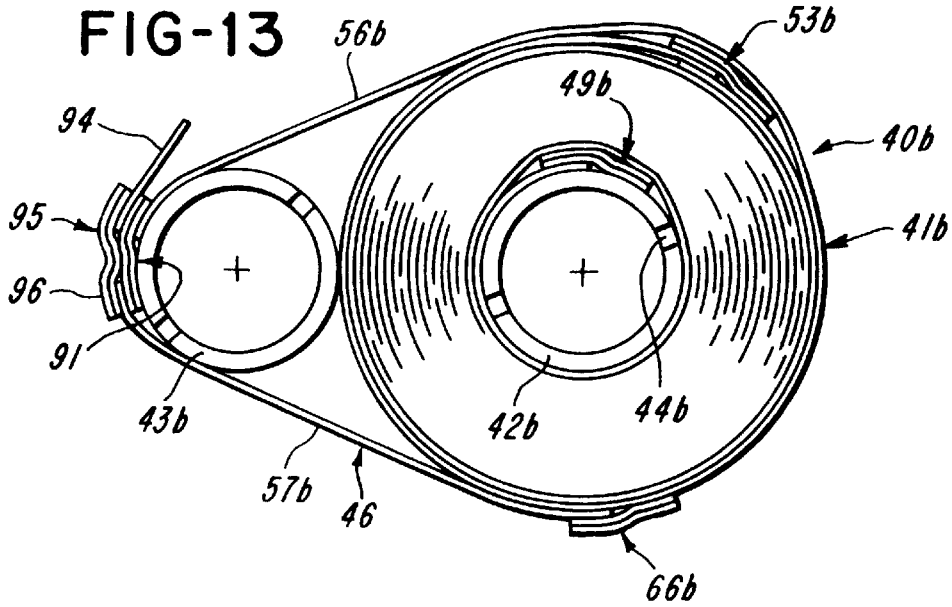
FIG. 13 is a side elevational view of the package.
Figure 14:
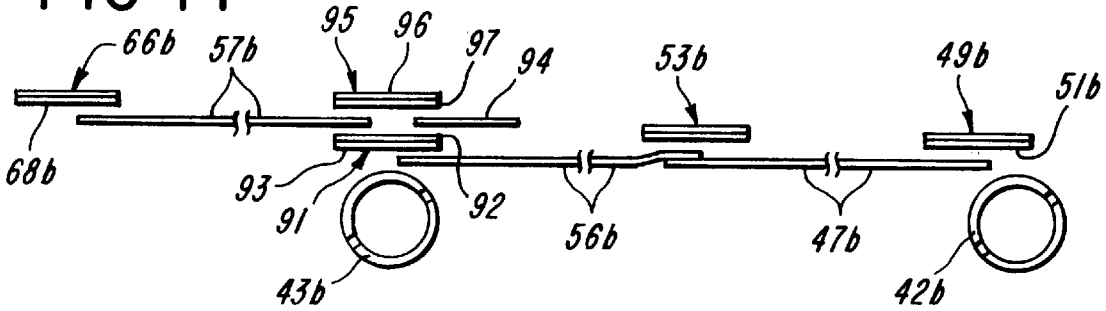
FIG. 14 is a developed, exploded, fragmentary, side elevational view of the web and the supply and take-up cores.

In the embodiment of FIGS. 12 through 14, the same reference characters are used as in the embodiment of FIGS. 1 through 8 for components having the same structure, function and relative location, with the addition of the letter "b". The package 40*b* differs from the package 40, as follows: The leader strip 56*b* is permanently secured to the core 43*b* by a transversely extending strip of adhesive tape generally indicated at 91. The tape 91 is comprised of flexible plastics film 92 with a coating of permanent pressure sensitive adhesive 93. A portion of the width of the tape 91 is adhered to the leader strip 56*b* and the remainder is adhered to the take-up core 43*b*. A marginal end of a transversely extending strip or tab 94 is spaced from the leader strip 57*b*. A transversely extending strip of pressure sensitive tape 95 spans across the respective marginal ends of the tab strip 94 and the leader strip 57. The tape 95 comprises film 96 and a coating of permanent pressure sensitive adhesive 97. The adhesive 97 is releasably adhered to the tape 91. As best shown in FIG. 13, the tape 66*b* releasably adheres the leader strip 57*b* to the outer surface of the web 46*b* at the roll 41*b*. When it is desired to unwrap the package 40*b*, the user pulls the tab 94 and separates the tape 95 from the tape 91. By continuing to pull on the tab 94 the user pulls the tape 66*b* loose from the outer surface of the web 46*b*. The user can then discard the leader strip 57*b* the tapes 66*b* and 95 and the tab 94 as a unit.

Figure 15:
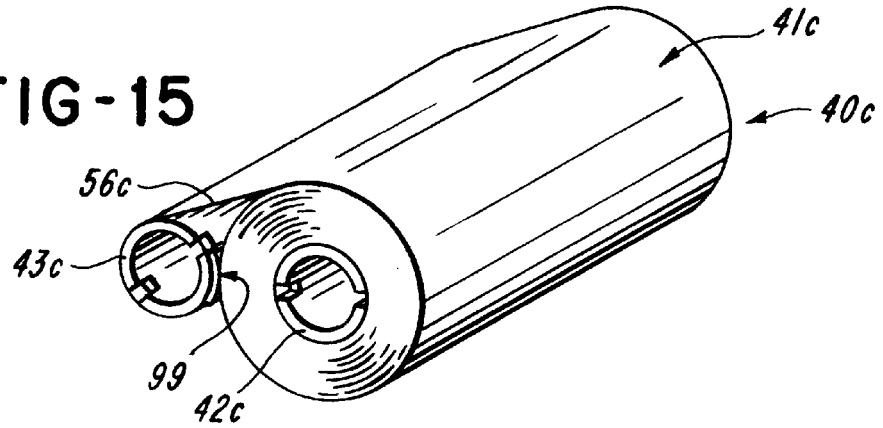
FIG. 15 is a perspective view of a package in accordance with the embodiment of FIGS. 15 through 17.
Figure 16:
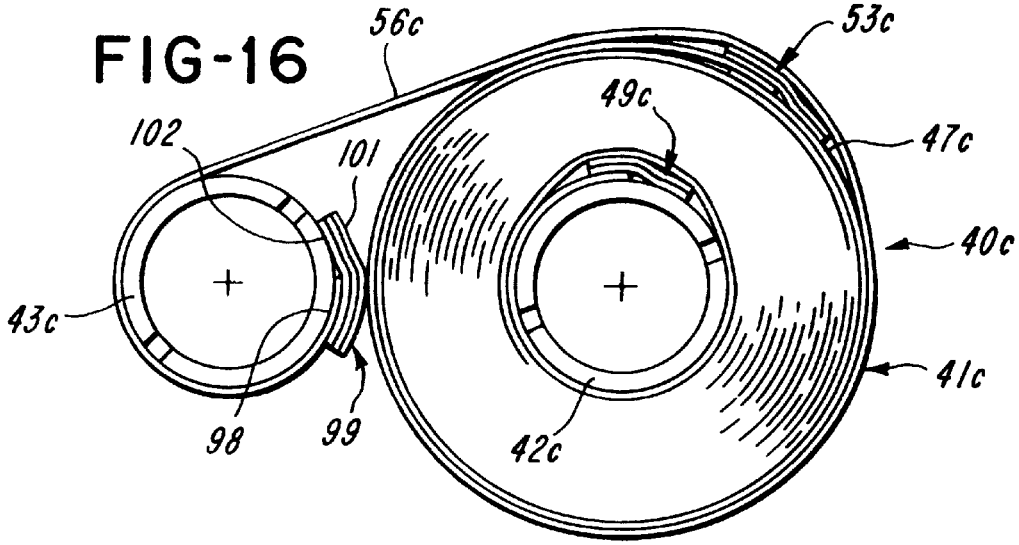
FIG. 16 is a side elevational view of the package.
Figure 17:
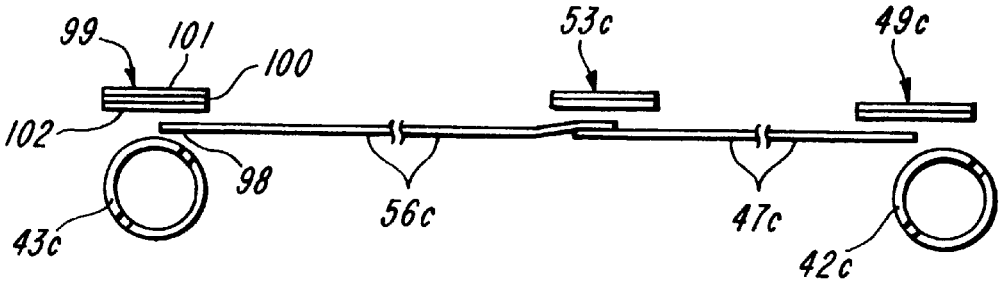
FIG. 17 is a developed, exploded, fragmentary, side elevational view of the web and the supply and take-up cores.

In the embodiment of FIGS. 15 through 17, the same reference characters are used as in the embodiment of FIGS. 1 through 8 for components having the same structure, function and relative location, with the addition of the letter "c". The leader strip 56*c* is shown to have a marginal end 98 located between a transversely extending transverse strip of double-faced adhesive tape generally indicated at 99 and the take-up core 43*c*. The tape 99 is comprised of a flexible plastics film 100 with a coating of permanent adhesive 101 on one side and a coating of permanent adhesive 102 on the other side. The tape 99 overlays the marginal end 98 and the outer periphery of the take-up roll 43*c* as best shown in FIG. 16. The adhesive 101 is releasably adhered to the outer surface of the roll 41*c*. In order to unwrap the package, the user simply grips the outside of the roll 41*c* and the outside of the take-up core 42*c* and pulls the adhesive 101 free from the outer surface of the roll 41*c*. The tape 99 stays with the take-up core 43*c* as the ink ribbon 47 is used in the printer.

Figure 18:
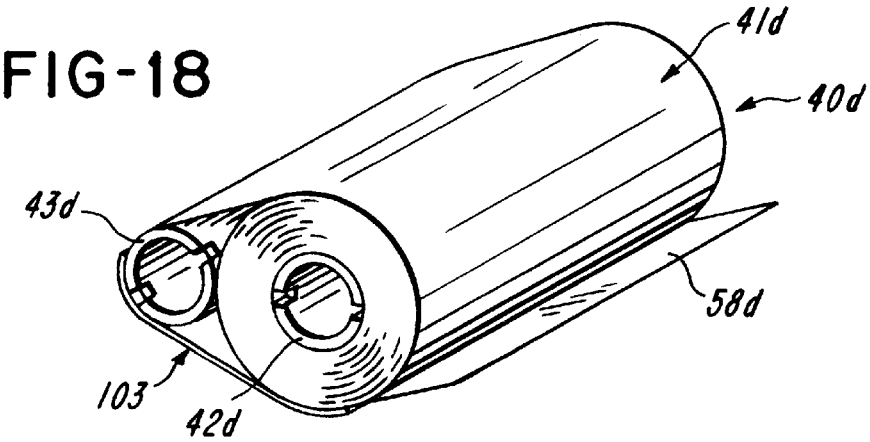
FIG. 18 is a perspective view of a package in accordance with the embodiment of FIGS. 18 through 20.
Figure 19:
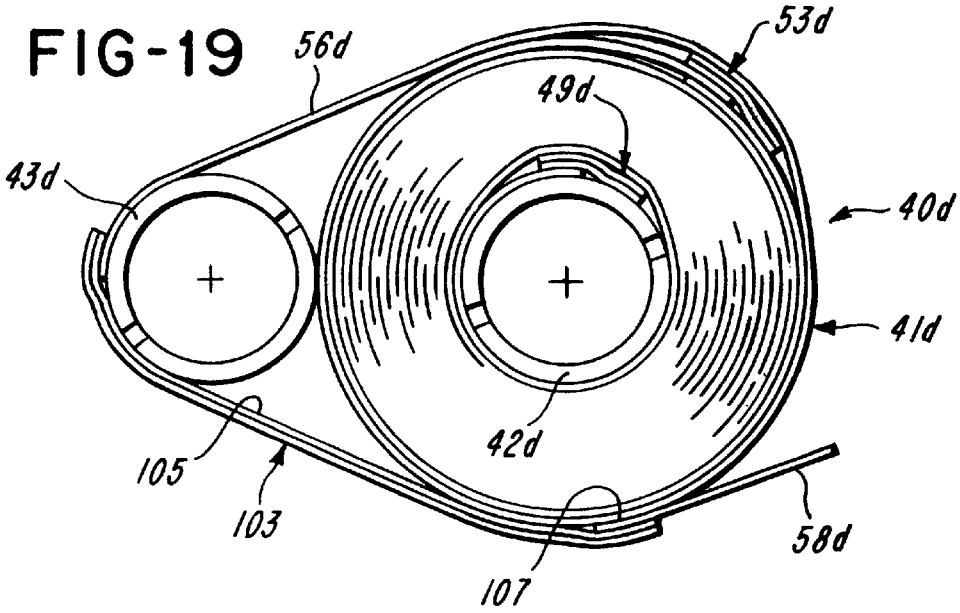
FIG. 19 is a side elevational view of the package.
Figure 20:
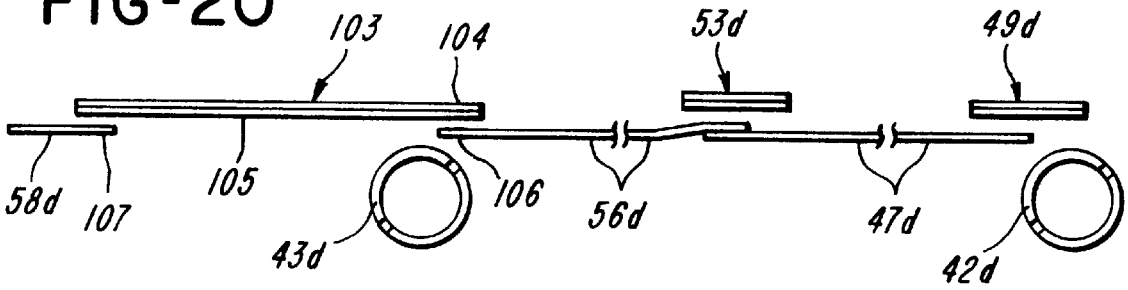
FIG. 20 is a developed, exploded, fragmentary, side elevational view of the web and the supply and take-up cores.

In the embodiment of FIGS. 18 through 20, the same reference characters are used as in the embodiment of FIGS. 1 through 8 for components having the same structure, function and relative location, with the addition of the letter "d". The package 40*d* includes a transversely extending strip of tape generally indicated at 103 comprising a plastics film 104 having a coating of permanent adhesive 105. The tape 103 is adhered to a marginal end 106 of the leader strip 56*d*, to the outer periphery of the take-up core 43*d*, to marginal end 107 of the tab 58*d* and to the other surface of the roll 41*d* as best shown in FIG. 19. To unwrap the package 40*d*, the user pulls on the tab 58*d* and separates the tape 103 from the outer surface of the roll 41*d*. In use, the tape 103 and the tab 58*d* thereon can be wound around the take-up core 42*d* as the ink ribbon 47*d* is being used in the printer.

It is evident that in the embodiments of FIGS. 1 through 20 to the take-up core is within or is enclosed by the portion of the web that forms the wrapper. In these embodiments, by way of example not limitation, the main web portion 52 is about 200 meters in length and the leader portion 52' is about 0.5 meter in length.

In the embodiments of FIGS. 21 through 34 the take-up core is on the outside of the portion of the web that is attached to the outer surface of the roll. In these embodiments, by way of example not limitation, the main web portion 52 is about 200 meters in length and the leader portion 52' is about 0.35 meter in length.

Figure 21:
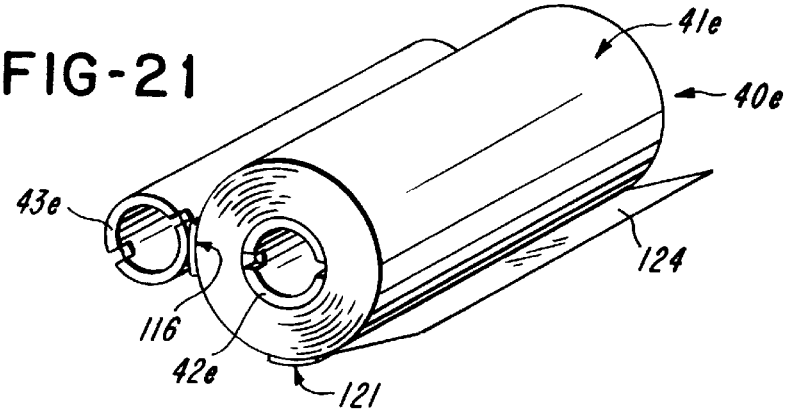
FIG. 21 is a perspective view of a package in accordance with the embodiment of FIGS. 21 through 25.
Figure 22:
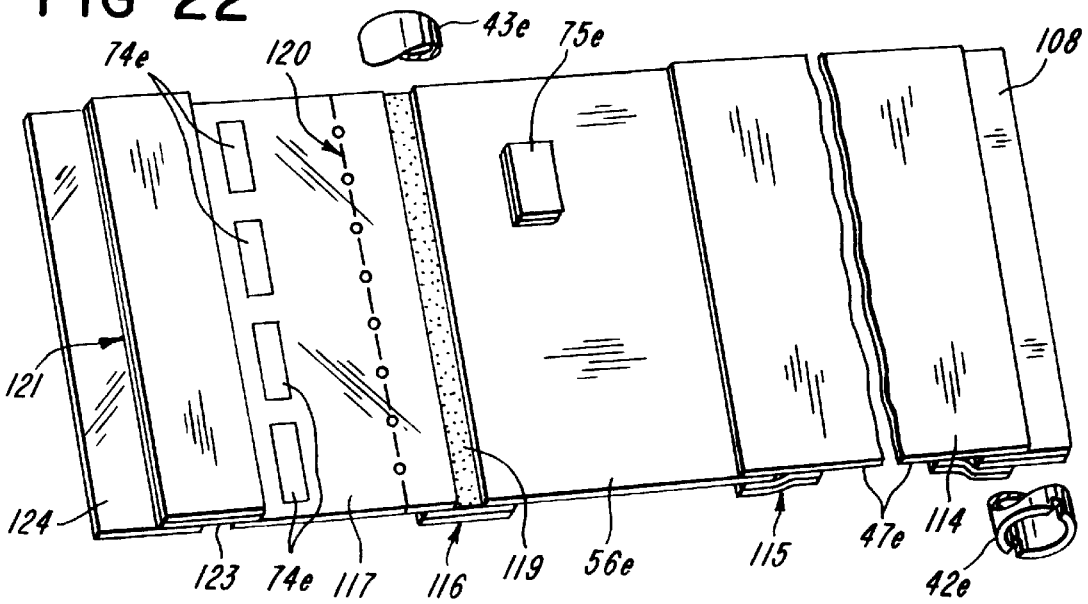
FIG. 22 is a developed, exploded, perspective view showing fragmentary portions of the web and the supply and take-up cores.
Figure 23:
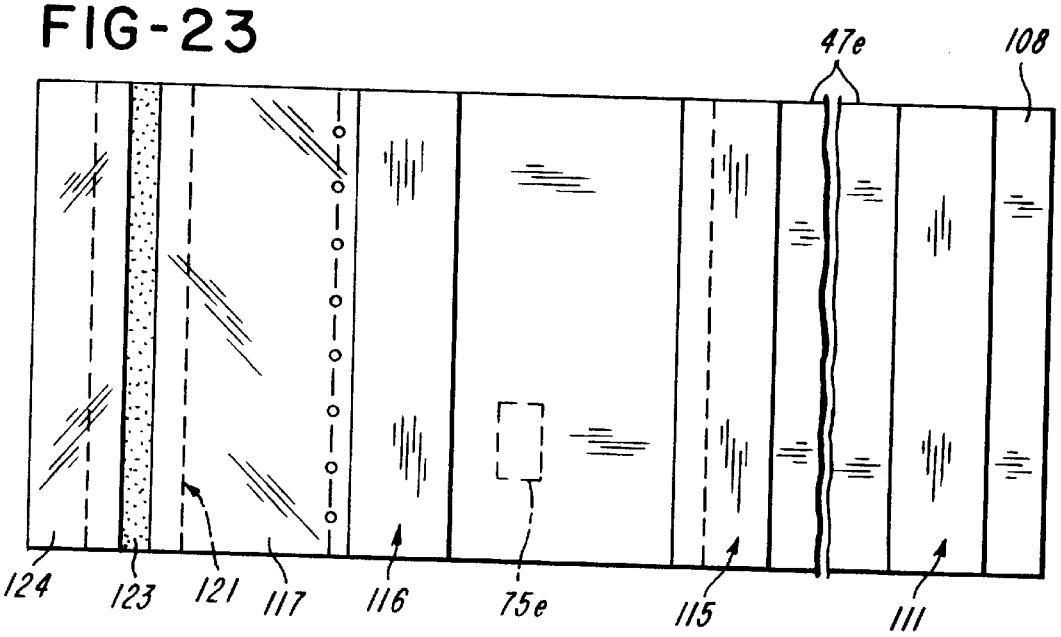
FIG. 23 is a bottom plan view of the web.
Figure 24:
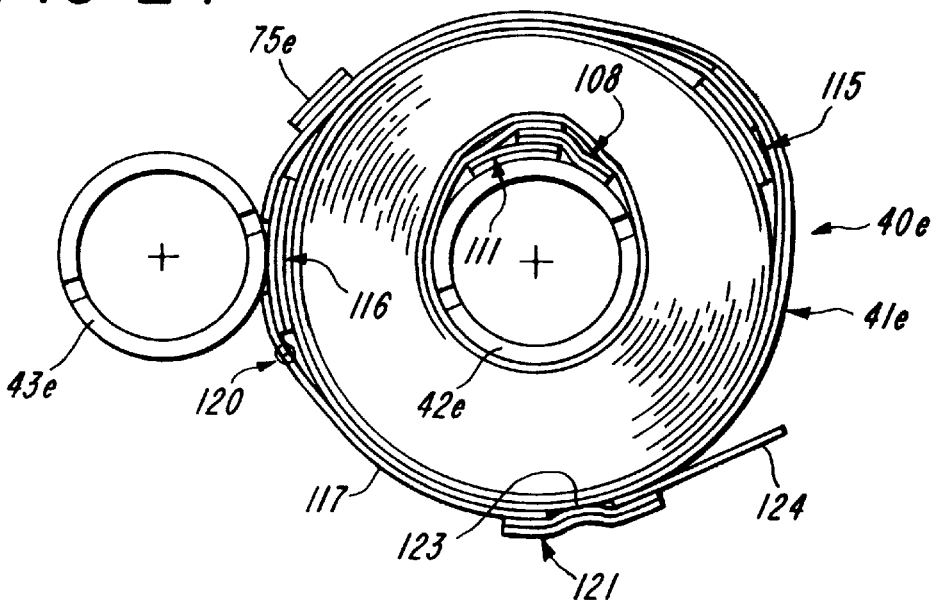
FIG. 24 is a side elevational view of the package.
Figure 25:
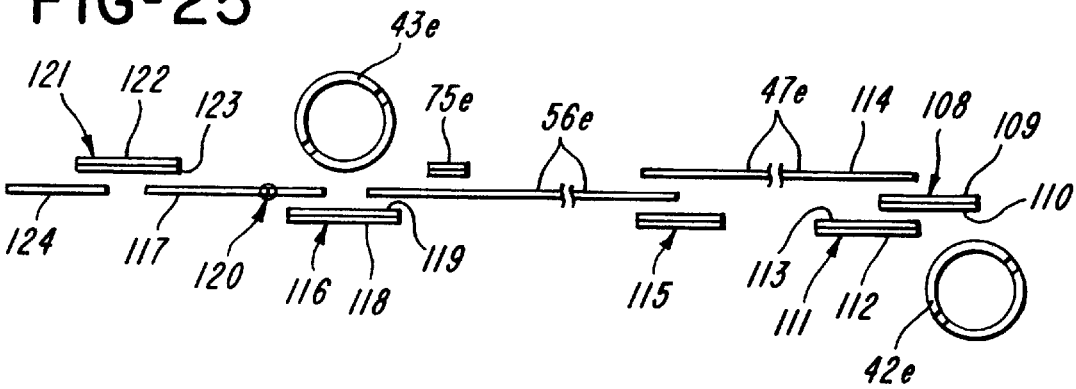
FIG. 25 is a developed, exploded, fragmentary, side elevational view of the package.

With reference to the embodiment of FIGS. 21 through 25, there is shown a transversely extending strip of adhesive tape generally indicated at 108 having a plastics film 109 and a coating of permanent pressure sensitive adhesive 110. There is also a transversely extending strip of adhesive tape generally indicated at 111 having a plastics film 112 and a coating of permanent pressure sensitive adhesive 113. The tapes 108 and 111 partially overlap each other as best shown in FIGS. 22, 24 and 25. The tape 111 is adhered to end portion 114 of the ink ribbon 47*e* and to the adhesive 110 on the tape 108. The adhesive 110 is adhered to the outer surface of the supply core 42*e*. A strip of adhesive tape generally indicated at 15 connects the ink ribbon 47*e* to a leader or leader strip 56*e*. A strip of adhesive tape generally indicated at 116 connects the leader strip 56*e* to a leader strip 117. The leader strips 56*e* and 117 are spaced apart and the adhesive tape 116 spans across and connects marginal ends of the leader strips 56*e* and 117. The strip of tape 116 includes a film 118 and a coating of permanent pressure sensitive adhesive 119. The adhesive 119 is permanently adhered to the take-up core 43*e*. The leader 117 is shown to have a transversely extending line of weakening generally indicated at 120. A transversely extending pressure sensitive tape generally indicated at 121 includes a plastics film 122 and a coating of permanent pressure sensitive adhesive 123. The tape 121 connects the leader strip 117 and a transversely extending leader strip or tab 124. The leader strip 117 and the tab 124 are spaced apart so that there is a stripe of exposed adhesive 123 as best shown in FIG. 23. The adhesive 123 is used to adhere the tape 121 to the outer surface of the roll 41*e* as best shown in FIGS. 21 and 24. When it is desired to unwrap the package 40*e*, the user pulls on the tab 124 and pulls the tape 123 from the outer surface of the roll 41*e*. Next, the user can tear the leader strip 117 at the line of weakening 120. The ink ribbon is now ready to be used in the printer or other device.

Figure 26:
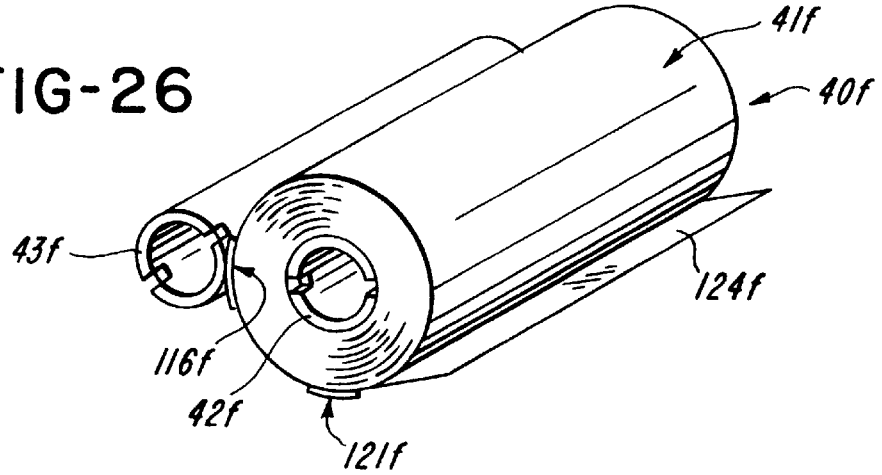
FIG. 26 is a perspective view of a package in accordance with the embodiment of FIGS. 26 through 28.
Figure 27:
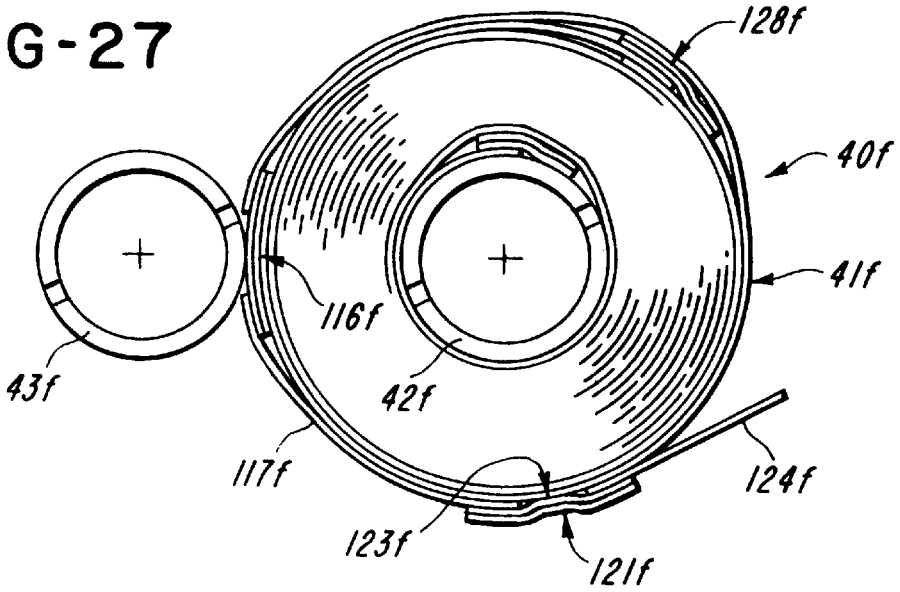
FIG. 27 is a side elevational view of the package.
Figure 28:
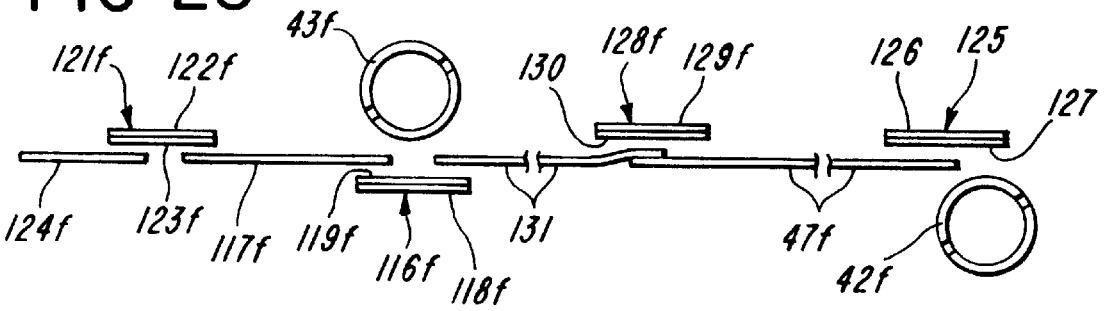
FIG. 28 is a developed, exploded, fragmentary, side elevational view of the web and the supply and take-up cores.

The package 40*f* of the embodiment of FIGS. 26 through 28 is identical to the embodiment of FIGS. 21 through 25 except that there is no line of weakening as in the embodiment of FIGS. 21 through 25 and except as noted hereafter. Accordingly, the same reference characters are used for components having the same structure, function and relative location with the addition of the letter "f". The package 40*f* includes the roll 41*f*. A transversely extending strip of tape 125 has a flexible film 126 and a coating of permanent pressure sensitive adhesive 127. The adhesive 127 connects the ink ribbon 47*f* to the supply core 42*f*. A transversely extending strip of pressure sensitive adhesive tape 128 includes a flexible plastics film 129 and a coating of permanent pressure sensitive adhesive 130 adhered to the overlapped marginal ends of the ink ribbon 47*f* and a transversely extending leader strip 131. The leader strip 131 adheres to the permanent pressure sensitive adhesive 119*f* on the tape 116*f*. To unwrap the package, the user pulls on the tab 124*f* and loosens the tape 121*f* from the outer surface of the roll 41*f*. The leader strip 117*f*, the tape 121*f* and the tab 124*f* as a unit can be wound onto the take-up core 42*f* while the ink ribbon 47*f* is being used in the printer or other device.

Figure 29:
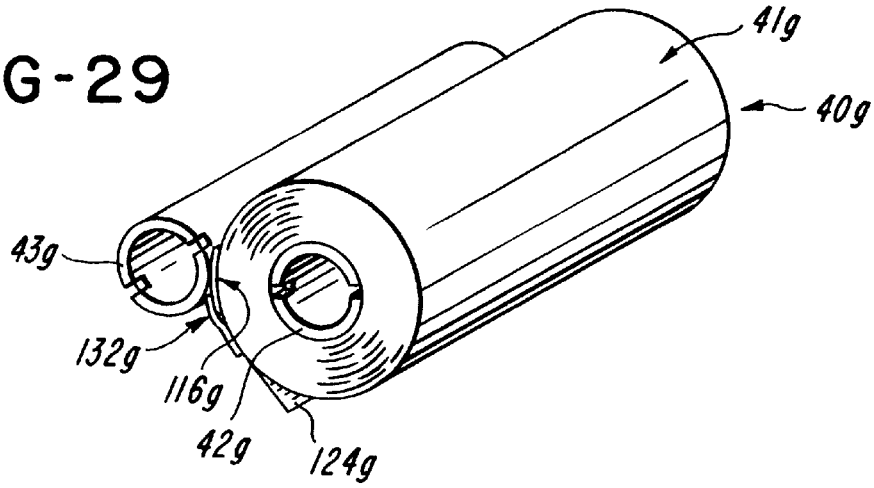
FIG. 29 is a perspective view of a package in accordance with the embodiment of FIGS. 29 through 31.
Figure 30:
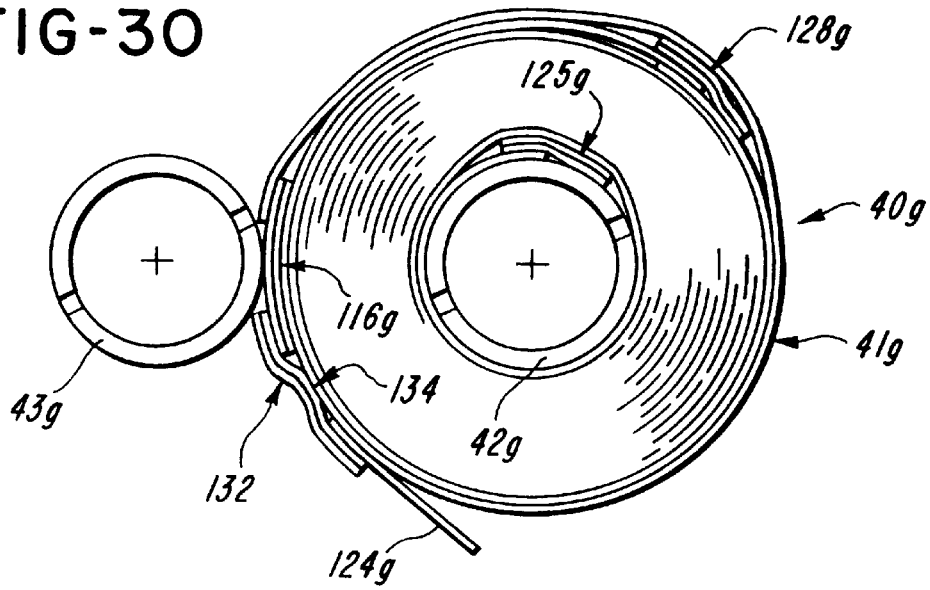
FIG. 30 is a side elevational view of the package.
Figure 31:
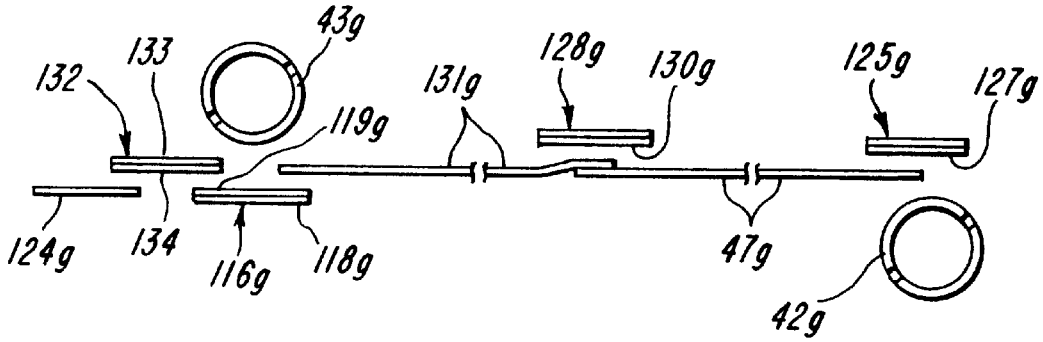
FIG. 31 is a developed, exploded, fragmentary, side elevational view of the web and the supply and take-up cores.

Except as noted, the embodiment of FIGS. 29 through 31 is the same as the embodiment of FIGS. 26 through 28 so that the components having the same structure, function and relative location use the same reference characters with the addition of the letter "g". The package 40*g* omits the leader strip 117*f* and adheres a transversely extending strip of tape 132 to the tape 116*g*. The tape 132 has a plastics film 133 and a coating of permanent pressure sensitive adhesive 134. The adhesive 134 adheres to the adhesive 119*g* on the tape 116*g* and to the tab 124*g*. The adhesive 119*g* also adheres to the outer periphery of the take-up core 43*g*. FIG. 30 shows the adhesive 134 on the tape 132 is adhered to the outer surface of the and to the leader 131*g*. To unwrap the package 40*g*, the user pulls on the tab 124*g* which pulls the tape 132 from the surface of the roll 41*g*.

Figure 32:
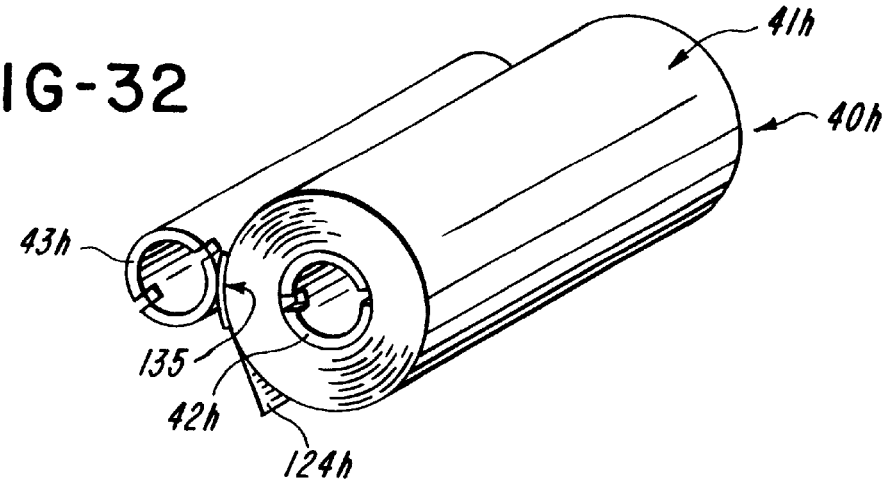
FIG. 32 is a perspective view of a package in accordance with the embodiment of FIGS. 32 through 34.
Figure 33:
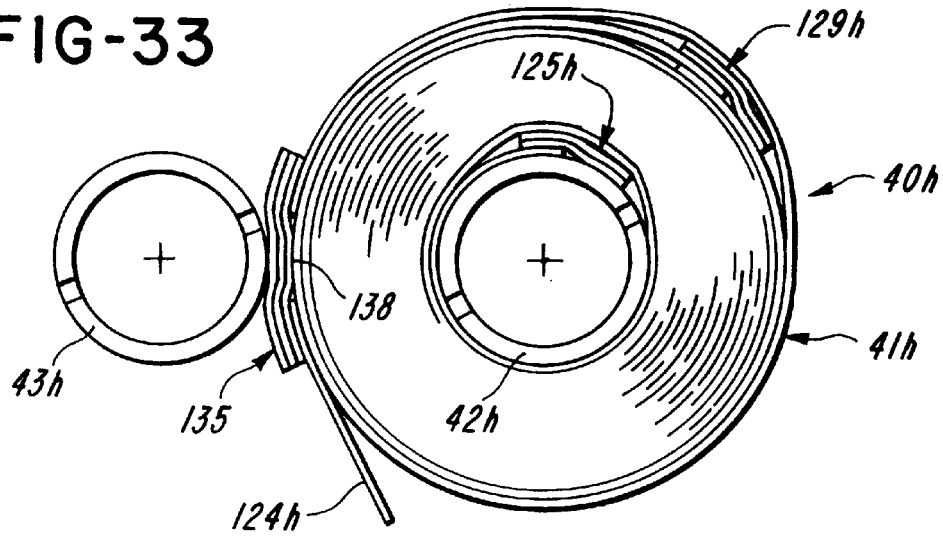
FIG. 33 is a side elevational view of the package.
Figure 34:
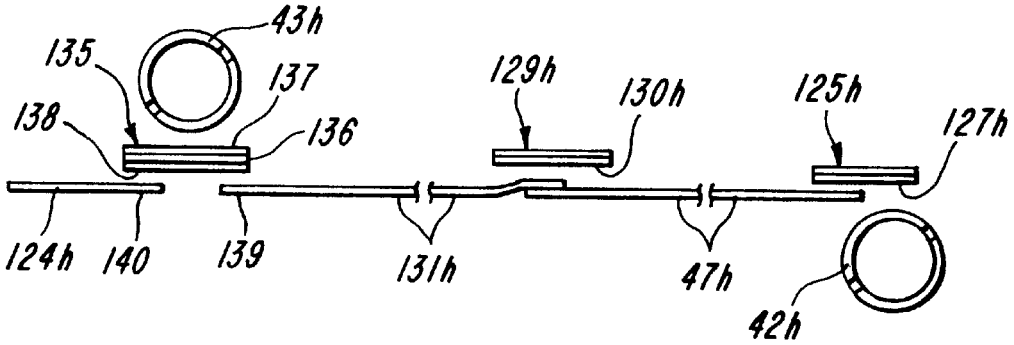
FIG. 34 is a developed, exploded, fragmentary, side elevational view of the web and the supply and take-up cores.

The package 40*h* of the embodiment of FIGS. 32 through 34 is identical to the embodiment of FIGS. 29 through 31 except as noted hereafter. Accordingly, the same reference characters are used with the addition of the letter "h" for components having the same structure, function and relative location. The package 40*h* includes a transversely extending strip of double-faced pressure sensitive adhesive tape generally indicated at 135 having a flexible plastics film 136 with a coating of permanent pressure sensitive adhesive 137 on one side and a coating of permanent pressure sensitive adhesive 138 on the other side. The adhesive 137 adheres to the outer periphery of the take-up core 43*h* and the adhesive 138 adheres to a marginal end 139 of the leader strip 131*h* and to a marginal end 140 of the tab or leader strip 124*h*. The marginal ends 139 and 140 are spaced apart leaving some adhesive 138 exposed. As best shown in FIG. 33, the adhesive 138 is adhered to the outer surface of the roll 41*h*. When it is desired to unwrap the package 40*h*, the user pulls on the tab 124*h* and loosens the adhesive 138 from the surface to which it is adhered.

Figure 35:
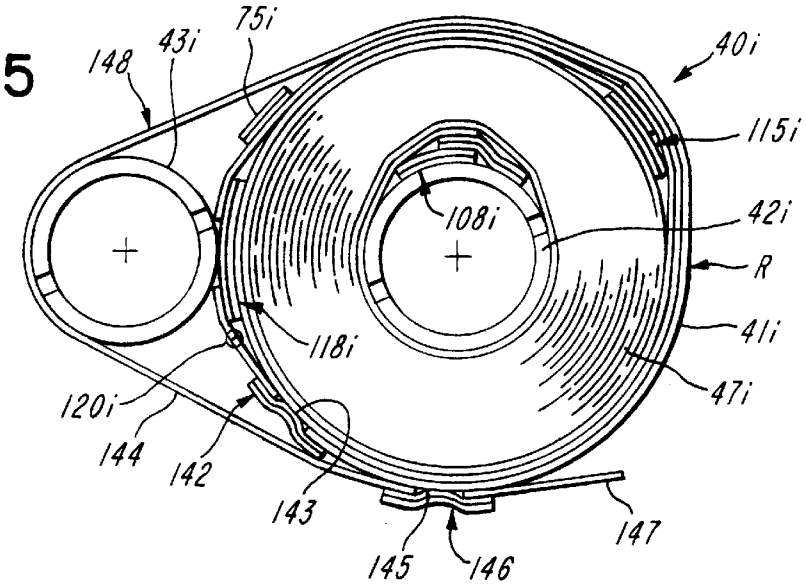
FIG. 35 is a side elevational view of a package in accordance with the embodiment of FIGS. 35 and 36.
Figure 36:
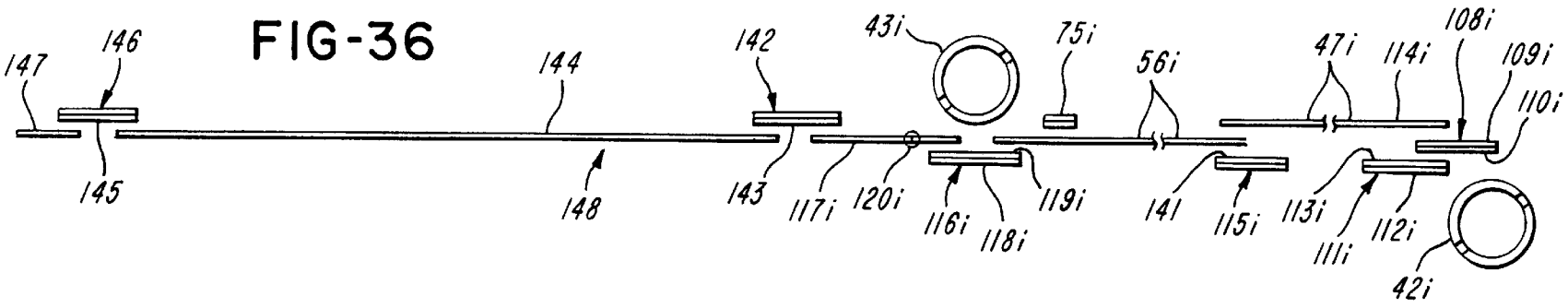
FIG. 36 is a developed, exploded, fragmentary view of the embodiment also shown in FIG. 35.

The embodiment of the package 40*i* disclosed in FIGS. 35 and 36 is identical to the embodiment of FIGS. 21 through 25 except as noted hereafter. Accordingly, the same reference characters are used with the addition of the letter "i" for components having the same structure, function and relative location. The package 40*i* includes a first leader portion 56*i* connected to the ink ribbon 47*i* by adhesive 141 on adhesive tape 115*i*. A strip of adhesive tape 118*i* has adhesive 119*i* which adheres to a marginal edge of first leader portion 56*i* and to a marginal edge of second leader portion 117*i*. The tape 118*i* spans the spaced apart leader portions 56*i* and 117*i* and the exposed adhesive 119*i* adheres to the outside of the take-up core 43*i*. The leader portion 117*i* has a transversely extending line of weakening 120*i*.

A transversely extending strip of adhesive tape 142 comprised of a strip of film 143 and underlying adhesive 143 adheres a marginal edge of the leader portion 117*i* to a marginal edge of relatively long third leader portion 144. The leader portions 117*i* and 144 are spaced apart leaving exposed the adhesive 143 which lies between the leader portions 117*i* and 144. This exposed adhesive 143 adheres the leader portions 117*i* and 144 to the surface of the roll R. The leader portion 144 is long enough so that the leader portion 144 can wrap around both the roll and the take-up core 43*i* and be again attached to the surface of the roll R by adhesive 145 on a transversely extending adhesive tape 146.

A fourth leader portion 147 serves as a manually graspable tab. The leader portions 144 and 147 are spaced apart and the tape 146 adhesively adheres marginal edges of the leader portions 144 and 146 to each other.

The leader portions 56*i*, 117*i*, 144 and 147 and tapes 116*i*, 142 and 146 comprise a leader 148. As shown, the leader 148 extends outwardly beyond the roll R. FIG. 35 shows the leader 148 attached to itself by the adhesive 145 of the tape 146. The leader portions and tapes which comprise the leader 148 preferably extend entirely across the web which is comprised of both the ink ribbon 47*i* and the leader 48, as in the embodiment of FIGS. 21 through 25. The line of weakening 120*i* preferably extends entirely across the web transversely.

The adhesives 141 and 119*i* are preferably permanent adhesives which adhere the leader 148 permanently to the ink ribbon 47*i* and to the take-up core 43*i*. There is no need or intention to remove the leader 148 from the ink ribbon 47*i* or to remove the core 43*i* from the leader 148. The adhesives 143 and 145 are preferably removable adhesives which adhere the leader 148 releasably or removably to itself, and specifically, to the surface of the roll R, at spaced locations.

When it is desired to use the package 40*i*, the user grasps the tab or leader portion 147 and pulls so as to release the adhesive 145 from the remainder of the leader 148. By unwinding the leader portion 148, and by further pulling the leader portion 117I, the leader portion 117*i* is torn off at the line of weakening 120*i*. The roll 41*i* and the take-up core 43*i* are now ready to be loaded into the printer for use. The part of the leader portion to the left of the line of weakening 120*i* as seen in FIG. 36, leader portions 144 and 147 and associated tapes 142 and 146 can now be discarded as a unit.

Figure 37:
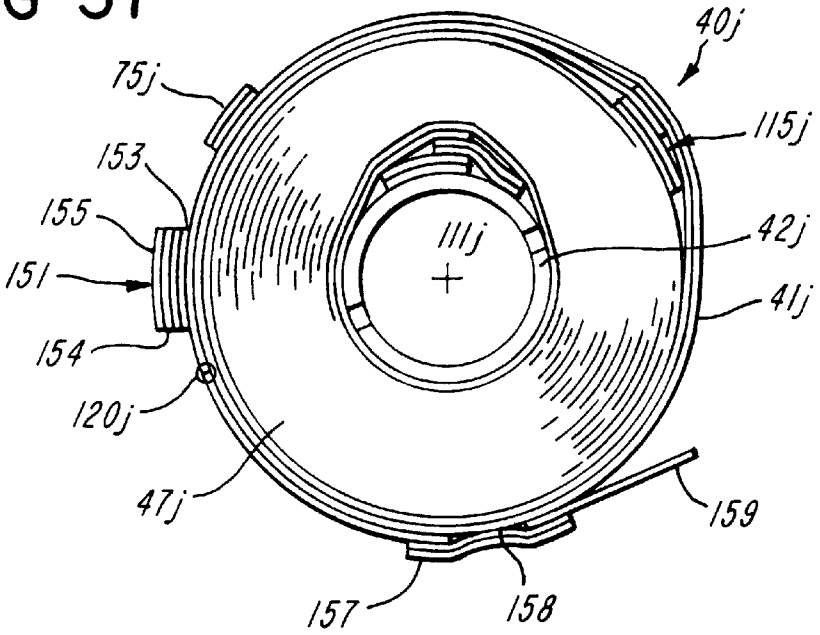
FIG. 37 is a side elevational view of a package in accordance with the embodiment of FIGS. 37 and 38.
Figure 38:
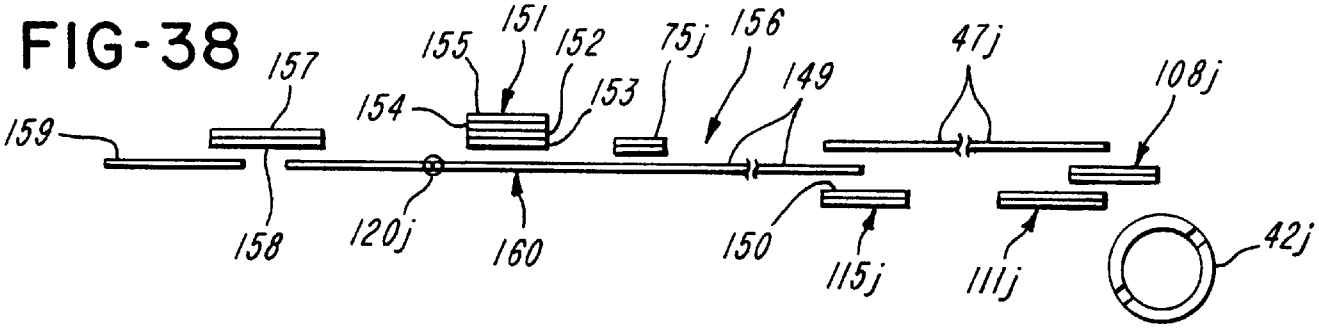
FIG. 38 is a developed, exploded, fragmentary view of the embodiment also shown in FIG. 37.

The embodiment of the package 40*j* disclosed in FIGS. 37 and 38 is identical to the embodiment of FIGS. 21 through 25 except as noted hereafter. Accordingly, the same reference characters are used with the addition of the letter "j" for components having the same structure, function and relative location. The package 40*j* includes a first leader portion 149 attached by a strip of adhesive tape 115*j* to the ink ribbon 47*j*. Adhesive 150 on the tape 115*j* is preferably a permanent adhesive which permanently adheres the first leader portion 149 to the ink ribbon 47*j*. A label 75*j* is adhered to the outer surface of the leader portion 149. A double-faced adhesive tape generally indicated at 151 has a plastic film 152, layers of preferably permanent adhesive 153 and 154, and a release liner 155 releasably adhered to the adhesive layer 154. Disposed beyond the adhesive tape 151 is a line of weakening 120*j* which extends preferably entirely transversely across the web 156. A strip of adhesive tape 157 having a layer of adhesive 158 is adhered to a marginal edge of the leader portion 159. The adhesive 158 is preferably of the removable type. As shown in FIG. 37, the adhesive 158 releasably adheres the leader portion 149 of a leader generally indicated at 160 to the outer surface of the roll 41*j*. The leader 160 is composed of the leader portions 149 and 159 and the tape 157.

In order to use the roll R, the user grasps the leader portion or tab 159 and pulls the leader 160 free from the outer surface of the roll 41*j* at the adhesive 158 and then the user tears the leader portion 149 at the line of weakening 120*j*. The user can now peel the release liner 155 from the adhesive 154 and attach the remainder of the leader 149 to a take-up core, like the take-up core 43*e* for example, by means of the adhesive 154. Alternatively, the user can attach the take-up core to the adhesive before the tape 157 released from its adherence to the surface of the roll 41*j* and before the leader 149 is torn along the line of weakening 120*j*. The adhesives 153 and 154 are preferably permanent adhesives which adhere permanently to the leader portion 149 and to the core, respectively.

The part of the leader portion 149 to the left of the line of weakening 120*j* in FIG. 38 and the associated tape 157 and leader portion 159, as well as the release liner 155 can be discarded when the package 40*j* has been opened and the core has been attached.

In the case of an ink ribbon in the various embodiments, the ink ribbon 47 through 47*j* is comprised of a flexible plastics film-onto which ink has been coated. The film is for example polyethylene. The adhesives used in the various embodiments are made with adequate aggressiveness to serve their intended function.

The invention is not limited to ink ribbons unless an ink ribbon is recited in a particular claim. Rather the invention is useful with various types of webs.

Unless otherwise indicated, the particular order of the steps recited in the appended claims is not critical; the particular order of steps can be changed without departing from the spirit of the invention.

Other embodiments and modifications of the invention will suggest themselves to those skilled in the art, and all such of these as come within the spirit of this invention are included within its scope as best defined by the appended claims.

What is claimed is:

1. A package, comprising: a take-up core, a web having a coating over at least most of its length and wound into a roll and having an outer portion extending beyond the outer surface of the roll and attached to the take-up core, the outer portion extending beyond the place of attachment to the take-up core and wrapped around the roll and the take-up core and adhered to itself.

2. A package as defined in claim 1, including a transverse line of weakening between the place of attachment to the take-up core and the place of adherence of the outer portion to itself.

3. A package as defined in claim 2, wherein the coating in comprised of ink.

4. A package, comprising: a take-up core, a web having a coating over at least most of its length and wound into a roll and having an outer portion extending beyond the outer surface of the roll and attached to the take-up core, a transverse line of weakening in the outer portion beyond take-up core, the outer portion being adhered to the surface of the roll beyond the line of weakening, and the outer portion beyond the place of adherence to the surface of the roll being wrapped around the roll and the take-up core and being adhered to itself.

5. A package, comprising: a take-up core, a web including an ink-ribbon over at least most of its length and wound into a roll and including a leader, the leader having a first leader portion attached to the ink ribbon, a first adhesive tape, a second leader portion spaced from the first leader portion and connected by the first adhesive tape spanning the first and second leader portions, the adhesive on the first adhesive tape disposed between the first and second leader portions being adhered to the take-up core, a transverse line of weakening in the second leader portion, a second adhesive tape, a third leader portion spaced from the second leader portion and connected by the second adhesive tape spanning the second and third leader portions, the adhesive on the second adhesive tape disposed between the second and third leader portions being adhered to the surface of roll, a third adhesive tape, a fourth leader portion spaced from the third leader portion and connected by the third adhesive tape spanning the third and fourth leader portions, the third leader portion being wrapped around the roll and the take-up core, the adhesive on the third adhesive tape disposed between the third and fourth leader portions being adhered to the surface of the roll.

6. A package, comprising: a web having a coating over at least most of its length and wound into a roll and having an outer portion extending beyond the outer surface of the roll, adhesive on the outer portion for attachment to a take-up core, a liner releasably adhered to the adhesive, the outer portion extending beyond the adhesive, and additional adhesive between the outer portion and the outer surface of the roll for adhering the outer portion to the outer surface of the roll.

7. A package as defined in claim 6, including a transverse line of weakening in the outer portion between the adhesive and the additional adhesive.

8. A package, comprising: a web having a coating over at least most of its length and wound into a roll and having an outer portion extending beyond the outer surface of the roll, a double-faced adhesive tape, one face of the adhesive tape being adhered to the outer portion and a liner releasably adhered to the other face of the adhesive tape, the outer portion extending beyond the adhesive tape, and adhesive spaced from the adhesive tape and disposed between the outer portion and the outer surface of the roll for adhering the outer portion to the outer surface of the roll.

9. A package as defined in claim 8, including a transverse line of weakening in the outer portion between the adhesive tape and the adhesive.

* * * * *

UNITED STATES PATENT AND TRADEMARK OFFICE

CERTIFICATE OF CORRECTION

PATENT NO. : 6,428,221 B1
DATED : August 6, 2002
INVENTOR(S) : Anthony C. Dolce et al.

It is certified that error appears in the above-identified patent and that said Letters Patent is hereby corrected as shown below:

Column 7,
Line 28, "15" should be -- 115 --.

Column 10,
Line 41, the second occurrence of "in" should be -- is --.

Signed and Sealed this

Twenty-first Day of January, 2003

JAMES E. ROGAN
*Director of the United States Patent and Trademark Office*